US005855754A

United States Patent [19]

Wiengarten et al.

[11] Patent Number: 5,855,754

[45] Date of Patent: Jan. 5, 1999

[54] METHOD AND APPARATUS FOR TWO-COAT ONE-FIRE ELECTROPHORETIC ENAMELING OF A METALLIC WORK PIECE

[75] Inventors: Karl Wiengarten, Beelen; Mario Sprickmann, Bielefeld, both of Germany

[73] Assignee: Miele & Cie. GmbH & Co., Guetersloh, Germany

[21] Appl. No.: 817,281

[22] PCT Filed: Sep. 11, 1996

[86] PCT No.: PCT/EP96/03974

§ 371 Date: Jun. 19, 1997

§ 102(e) Date: Jun. 19, 1997

[87] PCT Pub. No.: WO97/10371

PCT Pub. Date: Mar. 20, 1997

[30] Foreign Application Priority Data

Sep. 13, 1995 [DE] Germany ..... 195 33 668.2

[51] Int. Cl.[6] ..... C25D 13/02

[52] U.S. Cl. ..... 204/484; 204/491; 204/507; 204/622; 204/624

[58] Field of Search ..... 204/484, 507, 204/509, 622, 624, 490, 491

[56] References Cited

U.S. PATENT DOCUMENTS

| | | | |
|---|---|---|---|
| 4,208,262 | 6/1980 | Kubo et al. | 204/484 |
| 4,840,715 | 6/1989 | Misawa et al. | 204/484 |
| 4,904,365 | 2/1990 | Kawamura et al. | 204/623 |

*Primary Examiner*—Kathryn L. Gorgos
*Assistant Examiner*—Kishor Mayekar
*Attorney, Agent, or Firm*—Karl Hormann

[57] ABSTRACT

A method and apparatus for two-coat one-fire electrophoretic enameling of a work piece made of metal, wherein a first undercoat enamel slip deposit bath is followed by at least one excess slip removing bath before the undercoated work piece is submerged in a process bath including an additive for reducing the electrical resistance of the enamel biscuit followed sequentially by another rinsing bath, a finish enamel coating bath and not less than one final rinsing bath before the coated work piece is subjected to an enamel firing step.

20 Claims, 2 Drawing Sheets

METHOD AND APPARATUS FOR TWO-COAT ONE-FIRE ELECTROPHORETIC ENAMELING OF A METALLIC WORK PIECE

This is a 35 U.S.C. 371-National Stage application of International Application No: PCT/EP96/03974 filed Sep. 11, 1996.

BACKGROUND OF THE INVENTION

1. Field of the Invention

The invention, in general relates to an arrangement for electrophoretically enameling of articles made of metal and, more particularly, to an arrangement employing the so-called two coat one fire method including a process bath for applying an undercoat enamel coat, at least one subsequent rinsing bath ahead of a process bath in which a finish enamel coat is applied before at least yet one further rinsing bath and, finally, a processing furnace. The invention relates, furthermore, to a method of enameling by the above mentioned arrangement.

2. Discussion of the Prior Art

Enameling of metallic components in an electrophoretic enameling plant (ETE) by the two coat one fire method is generally known. As a rule, such a plant is equipped with two processing baths, several rinsing baths and a processing furnace. Enamel undercoating is carried out in a first processing bath. This is followed by two rinsing baths, with slip physically adhering to a component being rinsed off in the first processing bath. The slip is returned to the first processing bath by way of an enamel recovery unit. After another rinse in a second rinsing bath, a finish enamel coat is applied in a second processing bath. This is usually followed by at least one rinsing bath prior to both enamel coats being fired in the processing furnace.

During deposition of the enamel undercoat in the first processing bath, the slip component which produces the wrap-around is also deposited. The quantity of enamel deposited is generally proportional to the current strength and, hence, to the current density. However, in the case of irregularly shaped work pieces, the current density is not uniform over their entire surfaces. Thus, deposition of the finish enamel coat is rendered particularly difficult in those areas in which the current density (edges and curves) is highest, and in those areas more enameling defects is likely to occur.

A two coat one fire method of enamel coating in white and light colors is known from German patent 3,707,401 utilizing a special undercoat enamel frit which must have very particular properties. The disadvantage of such a method is that only a very particular composition of undercoat enamel frit can be used. Individual percentages of the components have empirically to be determined beforehand. Composing the frit is very complex, and yet in the problem areas of the work piece to be coated, enameling defects still cannot be avoided.

German Patent 3,626,424 discloses a method of electrophoretically enameling Al-free layers of enamel. The undercoat enamel is applied at a coating thickness of 80–120 $\mu$m, and the specific conductivity of the finish enamel coat is set at value below 2,000 $\mu S/cm^{-1}$. This method can only be practiced in connection with catalytic finish enamel which in contrast to white enamel constitutes a non-melted mixture of raw materials. Because of this, the application of the finish enamel coat is simpler.

OBJECTS OF THE INVENTION

It is an object of the invention to develop an apparatus and a method of electrophoretically enameling by the two coat one fire method by which the finish enamel is uniformly deposited regardless of the composition of the undercoat, of the finish enameling frits and of the shape of the work pieces.

SUMMARY OF THE INVENTION

The advantages gained by the invention are that while keeping the frits hitherto used, an enameled product is obtained which is free of enameling defects. More specifically, this is accomplished by providing an additional processing bath between the undercoat and the finish enamel application. This processing bath contains a solution including a chemical substance having a high aluminum ion affinity. Preferably, this substance attacks aluminum hydroxide and/or forms an undissociated compound with aluminum ions. Aluminum is a component of the undercoat enamel, and, therefore, the wrap-around may be improved by the process performed in an additional process basin. Preferably, ahead of and behind this additional processing bath there is to be arranged at least one rinsing bath in which carried over undercoat enamel slip or the chemical substance contained in the second process basin are rinsed off before the finish enamel coat is applied in an ensuing process basin. It is particularly advantageous to connect a filter device to the first rinsing bath after application of the undercoat enamel, in which carried over slip may be separated as a solid. This slip is then either fed back directly to the undercoat enamel coating processing bath or it is removed. In this manner, valuable raw materials may be saved and the environment is subjected to less pollution. It has been found to be particularly advantageous to maintain a constant processing bath temperature and to provide in the additional processing bath a defined constant concentration of the substance for reducing the layer resistance of the undercoat enamel.

DESCRIPTION OF THE DRAWINGS

The invention will be described in greater detail with reference to the following embodiment. In the drawings

DETAILED DESCRIPTION OF PREFERRED EMBODIMENTS

Figure 1:
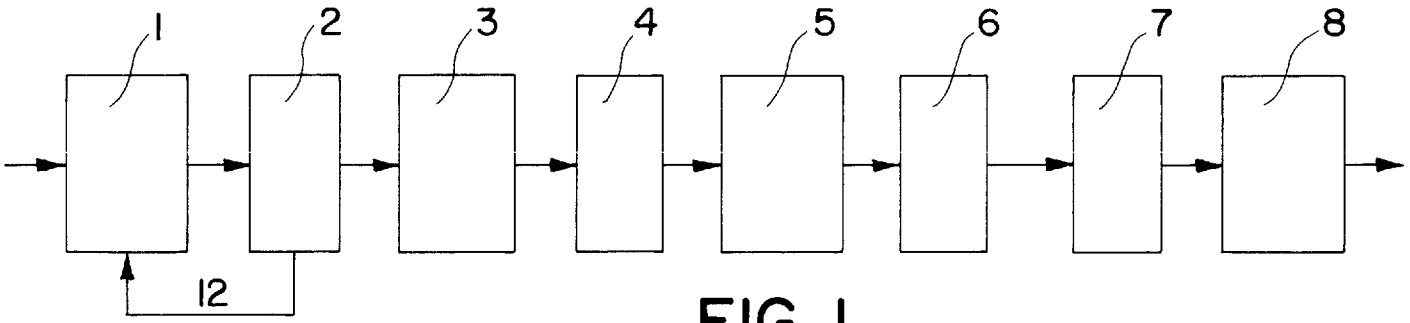
FIG. 1 is a schematic presentation of the arrangement for electrophoretically enameling by the two coat one fire method.

In FIG. 1, there is schematically shown an apparatus for electrophoretic enameling by the two coat one fire method. For enameling by this process, processing baths and rinsing baths are alternatingly and successively arranged in a predetermined sequence, in a known manner. Preferably, at least one rinsing bath 2;4;6;7 should be arranged after each processing bath 1;3;5. In the processing bath 1, there is provided an undercoat enamel slip 10 with which the work piece to be enameled is coated. Loosely attached undercoat enamel is rinsed away in a first rinsing bath 2. Advantageously, a filtering device 12 is connected to the rinsing basin 2 for separating carried over slip as a solid. This may be returned totally to the first processing bath 1.

The filtering device 12 utilized may be a conventional filter for solids or a sedimentation tower. Such filtering devices 12 make it possible either to return the recovered undercoat enamel slip 10 as well as the filtered matter to the appropriate baths 1 or 2 of the arrangement or to dispose of it separately. The rinsing bath 2 is followed by a processing bath 3 in which there is contained an additive of at least one substance which attacks the aluminum hydroxide and/or forms undissociated compounds with aluminum ions. The substance added to the processing bath 3 reduces the electrical resistance of the deposited enamel biscuit. It will be rinsed off the work piece 9 in the following rinsing bath 4. Thereafter, a finish enamel coat 11 is applied in the final processing bath 5 which because of the appropriately pretreated work piece 9 may be applied very uniformly. This processing bath 5 is followed by at least one, but preferably two rinsing baths 6, 7 before the two enamel layers 10, 11 are jointly fired in the processing furnace 8.

Chemical substances capable of attacking the aluminum hydroxide or of forming a stable compound with the aluminum ions may be added to the processing bath 3. By way of example, substances satisfying the requirements are those reacting in an acidic or basic and/or complexing manner, such as, for instance, citric acid. It is also possible to add a substance to the processing bath 3 which only solubilizes the precipitated enamel biscuit in order to reduce the electrical resistance of the layer. For that reason, phosphoric acid may also be advantageously added to the processing bath 3. The pH value of the bath 3 may vary between the acid and alkaline range. The total phosphate contents should be in excess of 100 mg/l in accordance with ISO 6878 T1 of 1986 (or in accordance with DIN 38405—part 11).

It has been found that an additional processing bath results in a significant improvement of the coating of edges of the work piece. The adherence of the enamel is very good using either citric acid or adding phosphoric acid to this processing bath 3. No differences in color could be detected in the finished enameled work piece 9. When using the mentioned additives in the processing bath 3, the thicknesses of the layers remain unchanged.

It has been found to be particularly advantageous if the substance for reducing the resistance of the layer is present in the processing bath 3 in a defined uniform concentration. Since the temperature of the processing bath should also be kept constant, the intensity of processing is defined only by the time of submersion in the processing bath 3. For each new shape of a work piece 9 the submersion times should be determined empirically beforehand. This would make it possible to feed differently shaped work pieces 9 into the enameling arrangement in an arbitrary sequence. The submersion times are coordinated with respective work pieces in accordance with the prior determinations. Thus, the enameling results will be uniformly good regardless of the shape of a work piece 9.

Figure 2:
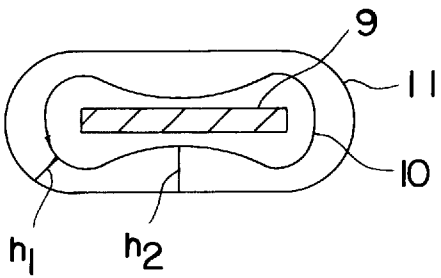
FIG. 2 depicts a sectional view of a work piece coated with undercoat and finish enamel while maintaining the electrical resistance of the undercoat enamel layer.

FIG. 2 depicts a coated work piece 9 the resistance of the undercoat enamel layer of which has not been reduced. At the ends of the work piece 9 less finishing enamel 11 is applied because of the increased deposition of undercoat enamel 10 ($h_1<h_2$), so that the finish enamel coat does not provide a uniformly sufficient cover. $h_1$ designates the thickness of the finish enamel coat 11 in marginal areas, and $h_2$ is the thickness of the finish enamel coat 11 in the substantially smooth or planar surface areas.

Figure 3:
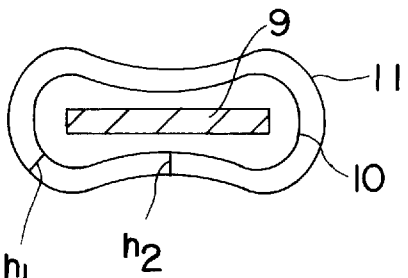
FIG. 3 depicts a sectional view of a work piece coated with undercoat and finish enamel at a reduced electrical resistance.

By comparison, FIG. 3 depicts an enameled work piece 9 in which the layer resistance of the undercoat enamel 10 was reduced in a processing bath 3 arranged after the processing bath 1. The electrical resistance of the layer was reduced by chemically attacking the enamel biscuit. To this end, the processing bath 3 includes substances which react in an acidic-basic-buffering or in a complexing manner and/or which form undissociated compounds with aluminum ions. Suitable additives in this processing bath 3 are, in particular, citric acid or phosphates. In accordance with given standards (ISO, DIN) an ortho-phosphate in the solution in the processing bath 3 should have a $PO_4^{3-}$ contents of at least 100 mg/l. By reducing the resistance it is possible to form a substantially uniform finish enamel coating 11 on the entire work piece. The uniformly thick layer 11 ($h_1 \approx h_2$) prevents the undercoat enamel 10 from showing through even through it is usually dark because of the adhesion oxides necessarily contained therein. The finish enamel coat 11 conforms uniformly to the shape of the undercoat enamel 10. Thus, with such an enameling arrangement the shape of the work piece 9 is irrelevant, whether or not it has curved marginal portions.

Figure 4:
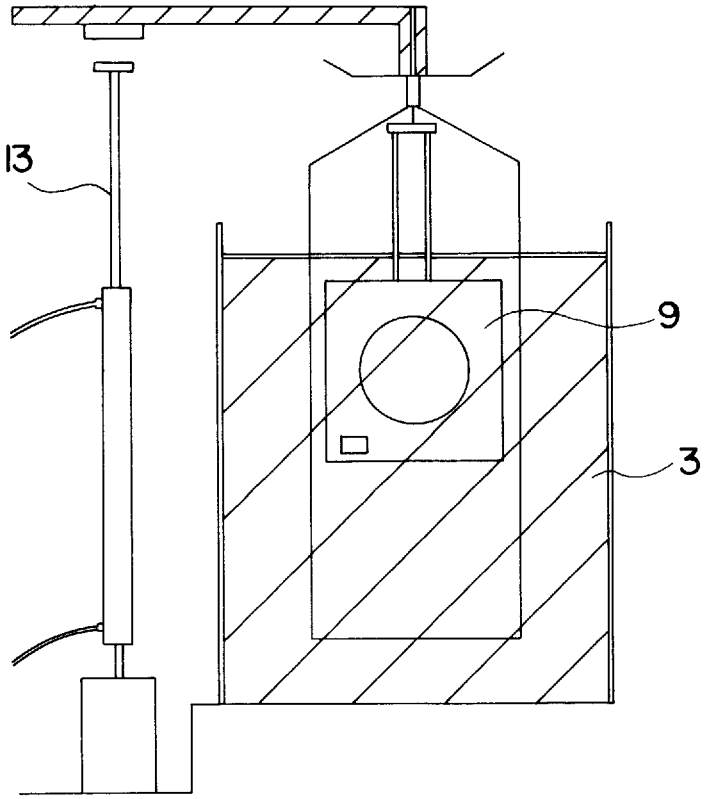
FIG. 4 schematically depicts a processing bath including lifting apparatus.

FIG. 4 depicts a lifting device 13 which may, for instance, be connected to the processing bath 3. At a uniform concentration in the processing bath 3, such a lifting device 13 makes it possible to keep work pieces 9 of different configurations in the bath 3 in accordance with variably set submersion times. Processing times for different work piece structures are empirically determined in advance, whereby the times are maintained by appropriately controlled actuation of the lifting device 13. The lifting device 13 may be provided with a pneumatic cylinder which is controlled such that it appropriately raises or lowers the lifting device with the work piece 9 arranged thereon.

What is claimed is:

1. A two-coat one-fire apparatus for electrophoretically depositing a uniform coat of enamel on a metallic work piece, comprising:

enamel slip containing means for electrophoretically depositing an undercoat enamel biscuit of a desired electrical resistance on the work piece;

means for reducing the electrical resistance of the enamel biscuit of the work piece;

means for electrophoretically depositing a finish enamel coat on the undercoated work piece; and means for firing the undercoat and finish enamel coat on the work piece.

2. The apparatus of claim 1, further comprising means for removing excess slip from the undercoated work piece.

3. The apparatus of claim 2, wherein the means for removing excess slip is a rinsing bath.

4. The apparatus of claim 3, wherein the slip containing means is a submersion bath.

5. The apparatus of claim 2, further comprising means for recirculating the excess slip from the rinsing bath to the slip containing means.

6. The apparatus of claim 5, wherein the slip recirculating means comprises filter means.

7. The apparatus of claim 1, wherein the means for reducing the electrical resistance is a submersion bath.

8. The apparatus of claim 7, wherein the means for reducing the electrical resistance is provided with means for moving the work piece into and out of the submersion bath.

9. The apparatus of claim 7, wherein the submersion bath is containing a substance for attacking aluminum hydroxide.

10. The apparatus of claim 7, wherein the submersion bath is containing a substance for forming undissociated aluminum ions.

11. The apparatus of claim 1, further comprising a rinsing bath between the means for reducing the electrical resistance and the means for depositing the finish enamel coat on the work piece.

12. The apparatus of claim 11, further comprising at least one rinsing bath between the means for depositing the finish enamel coat and the means for firing.

13. A two-coat one-fire method of electrophoretically depositing a uniform coat of enamel on a metallic work piece, comprising:

a first step of electrophoretically depositing from an enamel slip an enamel undercoat of a desired electrical resistance on the work piece;

a second step of reducing the electrical resistance of the enamel undercoat;

a third step of electrophoretically depositing a finish enamel coat on the undercoated work piece; and a fourth step of subjecting the undercoat and the finish enamel coat on the work piece to firing.

14. The method of claim 13, further including the step of removing excess undercoat enamel from the work piece before reducing the electrical resistance.

15. The method of claim 14, wherein the electrical resistance is reduced by a substance attacking aluminum hydroxide in the undercoat enamel.

16. The method of claim 14, wherein the electrical resistance is reduced by a substance forming undissociated aluminum ions in the undercoat enamel.

17. The method of claim 13, wherein the first, second and third steps are performed in submersion baths.

18. The method of claim 17, further comprising a step between the first and second steps of removing excess enamel slip from the work piece in a rinsing bath.

19. The method of claim 18, further including the step of subjecting the work piece to at least one rinsing bath following the third step.

20. The method of claim 18, further including the step of recirculating the excess slip to the submersion bath of the first step.

* * * * *